US008265518B2

(12) United States Patent
Kondo

(10) Patent No.: US 8,265,518 B2
(45) Date of Patent: Sep. 11, 2012

(54) IMAGE FORMING APPARATUS WITH FRAMING STRUCTURE

(75) Inventor: Hakudai Kondo, Nagoya (JP)

(73) Assignee: Brother Kogyo Kabushiki Kaisha, Nogoya-shi, Aichi-ken (JP)

( * ) Notice: Subject to any disclaimer, the term of this patent is extended or adjusted under 35 U.S.C. 154(b) by 316 days.

(21) Appl. No.: 12/729,328

(22) Filed: Mar. 23, 2010

(65) Prior Publication Data

US 2011/0052251 A1 Mar. 3, 2011

(30) Foreign Application Priority Data

Aug. 31, 2009 (JP) ..... 2009-200501

(51) Int. Cl.
*G03G 15/00* (2006.01)

(52) U.S. Cl. ..... 399/107

(58) Field of Classification Search ..... 399/107, 399/124, 111

See application file for complete search history.

(56) References Cited

U.S. PATENT DOCUMENTS

| | | | | |
|---|---|---|---|---|
| 5,105,221 | A * | 4/1992 | Takahashi et al. | 399/111 |
| 5,414,492 | A * | 5/1995 | Kubota | 399/111 |
| 5,527,028 | A | 6/1996 | Ishikawa | |
| 2010/0014887 | A1 * | 1/2010 | Tomatsu et al. | 399/107 |

FOREIGN PATENT DOCUMENTS

| | | |
|---|---|---|
| JP | 06-001483 | 1/1994 |
| JP | 2001-166550 | 6/2001 |
| JP | 2005126213 A * | 5/2005 |

* cited by examiner

*Primary Examiner* — Quana M Grainger
(74) *Attorney, Agent, or Firm* — Banner & Witcoff, Ltd

(57) ABSTRACT

An image forming apparatus includes: an image forming unit; a sheet feeding unit; an upper frame; a sheet feeding frame; and a lower frame. The upper frame includes: a pair of sheet-metal components, each of which is punched out in a right-left direction; and a first contact part facing a first direction. The sheet feeding frame is made of a resin component and is arranged between a space defined by the pair of sheet-metal components and includes a second contact part at a face facing the first direction. The lower frame supports the upper frame and the sheet feeding frame from below and includes a contacted part facing a second direction opposite to the first direction. A relative position in a front-rear direction between the upper frame and the lower frame is defined by contacting the contacted part with both of the first contact part and the second contact part.

5 Claims, 8 Drawing Sheets

IMAGE FORMING APPARATUS WITH FRAMING STRUCTURE

CROSS-REFERENCE TO RELATED APPLICATION

This application claims priority from Japanese Patent Application No. 2009-200501 filed on Aug. 31, 2009 the entire subject matter of which is incorporated herein by reference.

TECHNICAL FIELD

The present invention relates to an image forming apparatus.

BACKGROUND

Conventionally, a tandem-type image forming apparatus, which is structured so as to array a plurality of image forming units that form an image with individually different colors (for example, yellow, magenta, cyan, and black) in series along a conveying path of a recoding medium, is known.

Further, in the above-described tandem-type image forming apparatus, a structure has been also proposed, which is an upper frame (an image forming housing) incorporated these image forming units and make higher in rigidity than a lower frame (a sheet feeding housing) which loads the upper frame.

If the above-described frame structure is adopted, for example, a recessed part and a projection part on an installation site can be absorbed by distortion of the lower frame which is lower in rigidity. Therefore, the upper frame can be prevented from being twisted or distorted without increasing the rigidity of the frame as a whole. Then, the positioning accuracy can be kept high between the image forming units.

Moreover, in this type of image forming apparatus, upon installation of a sheet feeding mechanism equipped with movable components such as registration rollers. There is a case where the movable components and others are installed in advance on a resin-made frame (hereinafter, also referred to as a sheet feeding frame) and this sheet feeding frame is mounted on the upper or lower frame.

In the above-structured image forming apparatus, after the registration rollers are used to position the leading end of a recording medium, the recording medium is sent to the downstream side of a conveying path extending in a front-rear direction, and thereby fed to image forming unit may be adopted. In this instance, in order to form an image at an appropriate position on the recording medium, it is important to accurately position a relative position between "the sheet feeding frame into which the registration rollers are incorporated" and "the upper frame that support the image forming unit" in the front-rear direction (in other words, a direction in which the recording medium is sent).

However, there is a case where the upper frame is structured to have a pair of sheet-metal components that the pair of sheet-metal components is punched out respectively toward a right-left direction and installed upright spaced in the right-left direction and the sheet feeding frame is arranged between the pair of sheet-metal components. In this case, it is not necessarily easy to accurately position the sheet feeding frame relatively with respect to the upper frame in the front-rear direction.

For example, there is a case where the sheet feeding frame is positioned in the front-rear direction by contacting the sheet feeding frame to come into contact directly with a pair of the sheet-metal components arranged in parallel on both sides of the sheet feeding frame. In this case, it is necessary to form projections that is projecting from the sheet-metal component to the sheet feeding frame, or projecting from the sheet feeding frame to the sheet-metal component, such that the pair of the sheet-metal component and the sheet feeding frame come into contact therewith.

SUMMARY

However, in order to form projections projecting from the sheet-metal component to the sheet feeding frame, the sheet-metal component are subjected to a bending process that forms the projections. Thus, it is not easy to form the projections higher in positioning accuracy.

Further, in order to form projections projecting from the sheet feeding frame to the sheet-metal component, it is necessary to make holes or notches, which contact the projections, on the sheet-metal component and to guide the projections into the holes or notches. Therefore, a right-left dimension of the sheet feeding frame is larger than a dimension between the sheet-metal components. Thereby, working for installing the sheet feeding frame between the sheet-metal components is made difficult or an image forming apparatus is made larger in dimension as a whole by the projection projected outside the sheet-metal component.

Accordingly, an object of the present invention is to provide an image forming apparatus capable of accurately positioning the upper frame with respect to the sheet feeding frame, the image forming apparatus is structured that an upper frame has a pair of the sheet-metal components and a sheet feeding frame is provided between the pair of the sheet-metal components.

BRIEF DESCRIPTION OF THE DRAWINGS

FIG. 4A is a left side view showing a site at which one sheet-metal component is screwed to the lower frame, while

FIG. 7A is a perspective view showing a vicinity at which a second contact part is in contact with a contacted part, while

DETAILED DESCRIPTION

General Overview

Figure 1:
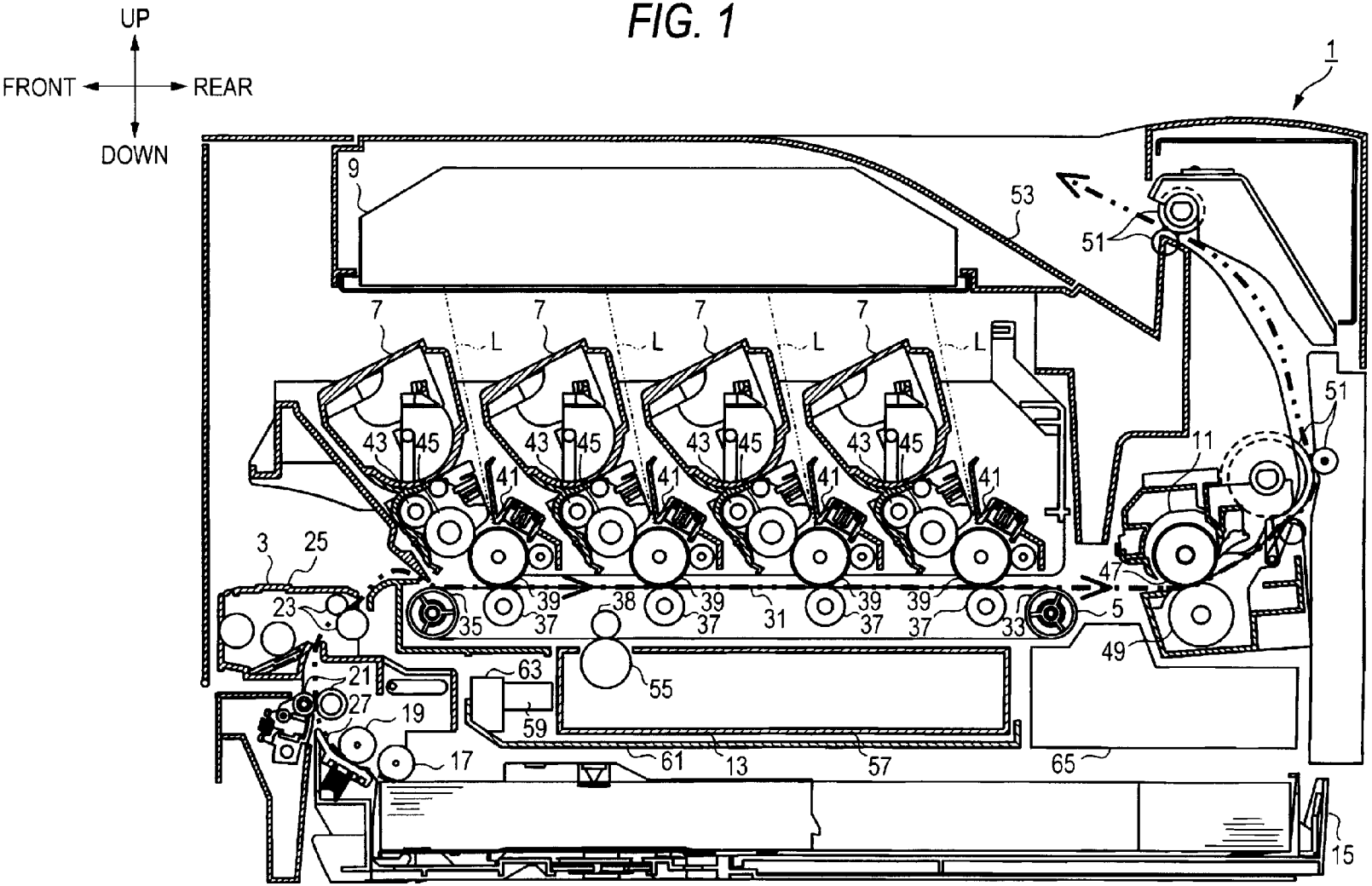
FIG. 1 is a longitudinal sectional view showing an image forming apparatus when viewed from the right side face.

According to a first aspect of exemplary embodiment the invention, an image forming apparatus comprising: an image forming unit that forms an image on a recording medium; a sheet feeding unit that feeds the recording medium to the image forming unit, the sheet feeding unit positioning a leading end of the recording medium and feeding the recording medium to a downstream side of a conveying path extending in a front-rear direction; an upper frame comprising: a pair of sheet-metal components, each of which is punched out in a right-left direction substantially perpendicular to the front-rear direction, and which defines a space therebetween in the right-left direction; and a first contact part, which is an end face formed when the pair of sheet-metal components was punched out, and which faces a first direction, wherein the upper frame supports the image forming unit from the right-left direction by the pair of sheet-metal components; a sheet feeding frame, which is made of a resin component, which is arranged between the space defined by the pair of sheet-metal components, and to which the sheet feeding unit is mounted, the sheet feeding frame comprising a second contact part at a face facing the first direction; and a lower frame, which supports the upper frame and the sheet feeding frame from below, and which comprises a contacted part that faces a second direction opposite to the first direction, wherein a relative position in the front-rear direction between the upper frame and the lower frame is defined by contacting the contacted part with both of the first contact part and the second contact part.

Accordingly, the first contact part is an end face formed when the pair of sheet-metal components was punched out. Therefore, the first contact part can be formed more accurately than with a bending process in the upper frame.

Further, since the sheet feeding frame is made of resin component, it is possible to form accurately the second contact part formed on the sheet feeding frame as well.

Therefore, both of the first contact part and the second contact part, which have been accurately formed, are contacted with the contacted part formed on the lower frame. Thereby, the upper frame can be accurately positioned relatively with respect to the sheet feeding frame in the front-rear direction, in spite of the fact that the upper frame is not contacting directly with the sheet feeding frame.

Therefore, the sheet feeding unit incorporated into the sheet feeding frame and the image forming unit supported by the upper frame are arranged so as to give an appropriate positional relationship in the front-rear direction.

Thereby, the sheet feeding unit position the leading end of a recording medium and feed the recording medium to the downstream side of a conveying path extending in a front-rear direction. The recording medium arrives at the image forming unit accurately in the front-rear direction. Therefore, it is possible to improve the accuracy of an image forming position on the recording medium.

According to a second aspect of exemplary embodiment the invention, the lower frame further comprises a positioning projection part that is projected upward, wherein the upper frame further comprises a positioning recessed part, which is formed when the pair of sheet-metal components was punched out, and which is recessed from a lower end of the pair of sheet-metal components toward upward, wherein the contacted part is an outer face of the positioning projection part facing forward, and wherein the first contact part is an inner face of the positioning recessed part facing backward.

Accordingly, the positioning projection part is fitted into the positioning recessed part, by which the first contact part and the contacted part are arranged so as to oppose each other. Thereby, the first contact part is easily contact the contacted part.

According to a third aspect of exemplary embodiment the invention, when the positioning projection part is mounted to the positioning recessed part to contact the first contact part with the contacted part, a gap is formed between an outer face of the positioning projection part facing backward and an inner face of the positioning recessed part facing forward.

Accordingly, when the positioning projection part is mounted to the positioning recessed part to contact the first contact part with the contacted part, a gap is formed between an outer face of the positioning projection part facing backward and an inner face of the positioning recessed part facing forward. Therefore, the positioning projection part are allowed to be deformed or inclined along with deformation of the lower frame, thereby giving no adverse influence to the accuracy of the upper frame.

According to a fourth aspect of exemplary embodiment the invention, each of the pair of sheet-metal components is fixed to the lower frame at three or more fixed sites, and wherein at least one of the fixed sites is deviated from straight lines passing through other two of the fixed sites.

Accordingly at least one of the fixed sites is deviated from straight lines passing through other two of the fixed sites, and these three fixed sites are arranged so as to depict a triangle. Therefore, as compared with a case where these three fixed sites are aligned, it is possible to improve the strength of each of the sheet-metal components when mounted on the lower frame.

According to a fifth aspect of exemplary embodiment the invention, a reference fixed site, which is one fixed site closest to a contact position of the first contact part and the contacted part, and which has a first fixed structure that prevents relative displacement between the lower frame and the pair of sheet-metal components even when the lower flame is deformed, and wherein each of the fixed sites other than the reference fixed site has a second fixed structure that allows relative displacement between the lower frame and the pair of sheet-metal components when the lower frame is deformed.

Accordingly, a reference fixed site, which is one fixed site closest to a contact position of the first contact part and the contacted part, and which has a first fixed structure that prevents relative displacement between the lower frame and the pair of sheet-metal components even when the lower flame is deformed. Therefore, when the lower frame is deformed, the first contact part can be kept in contact with the contacted part. Further, each of the fixed sites other than the reference fixed site has a second fixed structure that allows relative displacement between the lower frame and the pair of sheet-metal components when the lower frame is deformed. Therefore, no excessive force is applied to the sheet-metal component upon deformation of the lower frame, thus it is possible to prevent or suppress the sheet-metal component from being deformed.

Exemplary Embodiment

Next, a description will be given for an exemplary embodiment of the present invention by referring to one example.

[Structure of the Image Forming Apparatus]

The image forming apparatus 1 shown in FIG. 1 is an apparatus that form an image on a recording medium such as cut paper by an electro-photographic method, which is called as a laser printer in general. In addition, in the following explanation, up-down, right-left and front-rear directions indicated in the drawings are used.

Regarding these directions, where the image forming apparatus 1 is placed on a horizontal plane, a direction at which a plumb line extends is defined as a vertical direction, a direction parallel with a conveying direction of a recording medium during formation of an image is defined as a front-rear direction, and a direction substantially perpendicular to each of the vertical and front-rear directions is defined as a right-left direction. However, these directions are defined only for explaining a relative positional relationship of individual components of the image forming apparatus 1 and shall not be interpreted that the image forming apparatus 1 is to be placed in a certain direction.

The image forming apparatus 1 is provided with a sheet feeding unit 3, a belt unit 5, process cartridges 7, a scanner unit 9, a fixing device 11, a cleaning device 13 and others.

The sheet feeding unit 3 is installed for sending send a recording media accommodated inside a sheet feeding cassette 15 to the downstream side of a conveying path. The sheet feeding unit 3 includes a pickup roller 17, a separation roller 19, attachment removing rollers 21, registration rollers 23 and others, and these rollers are mounted on the sheet feeding frame 25.

The recording media accommodated inside the sheet feeding cassette 15 are taken out from the sheet feeding cassette 15 by the pickup roller 17 and sent to the downstream side of a conveying path. Even if the recoding media are sent to the downstream side of the conveying path, with plural media overlapped with each other, these media to be recorded are separated into one sheet each by the separation roller 19 and a separation pad 27 arranged so as to oppose the separation roller 19 and then sent to the downstream side of the conveying path.

Then, after attachments (for example, paper dust) attached on the surface of a recording medium are removed by the attachment removing rollers 21, the recording medium arrives at the registration rollers 23. At this time, the recording medium is in contact with the registration rollers 23, by which the leading end of the recording medium is positioned to optimize a print starting position on the recording medium.

Further, in association with this positioning, the recording medium is corrected for inclination with respect to the conveying direction, thereby preventing the recording medium from passing obliquely. After the positioning by the registration rollers 23, the recording medium sent from the registration rollers 23 is conveyed between the belt unit 5 and the process cartridges 7.

The belt unit 5 includes a conveying belt 31, a belt driving roller 33, a driven roller 35, transfer rollers 37, a backup roller 38 and others. The conveying belt 31 is an endless belt stretched between the belt driving roller 33 and the driven roller 35. The conveying belt 31 is driven by the belt driving roller 33 and circulated on a predetermined circulating path.

The belt driving roller 33 is driven and rotated by power transmitted from a motor (not illustrated) in a clockwise direction as shown in FIG. 1. On the other hand, the driven roller 35 is rotated by following the conveying belt 31 when the conveying belt 31 is driven circularly.

In the driven roller 35, a bearing (not illustrated) that support pivotally the rotating shaft of the driven roller 35 is kept urged by a spring mechanism (not illustrated) in such a direction that is spaced away from the belt driving roller 33. Thereby, an appropriate tensile force is applied to the conveying belt 31.

Four process cartridges 7 are arrayed in series above the belt unit 5 so as to be spaced at equal intervals. Each of the process cartridges 7 includes a photosensitive member 39, a charger 41, a feeding roller 43, a developing roller 45 and others. The conveying belt 31 is in a state of being inserted between four transfer rollers 37 installed on the belt unit 5 and photosensitive members 39 at the lower end of each of the process cartridges 7. A recording medium conveyed between the belt unit 5 and the process cartridges 7 is moved together with the conveying belt 31 from forward to backward inside the image forming apparatus 1.

A scanner unit 9 is provided above the process cartridges 7, and a laser light beam is allowed to be emitted from the scanner unit 9 to the photosensitive members 39 installed on each of the process cartridges 7 (refer to the double dotted lines L shown in FIG. 1).

When an image is formed on a recording medium, the surface of the photosensitive member 39 is charged by the charger 41 and thereafter the laser light beam emitted from the scanner unit 9 is used to scan the surface of the photosensitive member 39. Thereby, an electrostatic latent image is depicted on the surface of the photosensitive member 39.

Further, inside each of the process cartridges 7, toner supplied by the feeding roller 43 is carried and held on the surface of the developing roller 45, and the developing roller 45 contact the surface of the photosensitive member 39. As a result, the electrostatic latent image depicted on the surface of the photosensitive member 39 is made apparent to result in a state that a toner image is carried and held on the surface of the photosensitive member 39.

The formed toner image is transferred to the recording medium when the recording medium moving together with the conveying belt 31 is inserted between the transfer rollers 37 and the photosensitive members 39. Colors of toner used in each of the four process cartridges 7 are black, yellow, magenta and cyan sequentially from the upstream side of a conveying path of a recording medium.

Therefore, the toner image of each color is transferred on the recording medium according to the above sequence. Finally, a full color toner image is formed on the recording medium. Thus, the recording medium on which the toner image has been formed is sent further to the downstream side of the conveying path by the conveying belt 31 and arrives at the fixing device 11.

The fixing device 11 includes a heating roller 47 and a press roller 49 to conduct heating and pressing, with the recording medium inserted between the heating roller 47 and the press roller 49. Thereby, the toner image is fixed on the recording medium.

Then, the medium to be sent from the fixing device 11 is further conveyed by several conveying rollers 51 and discharged on a sheet discharge tray 53 formed on an upper face of the image forming apparatus 1.

The cleaning device 13 is installed for removing attachments such as a waste toner and a paper dust attached on the conveying belt 31. The cleaning device 13 includes a belt cleaning roller 55, a waste toner box 57, a waste toner sensor 59 and others.

The belt cleaning roller 55 contact the conveying belt 31 at a lower part of the conveying belt 31, the conveying belt 31 inserted between the backup roller 38 and the belt cleaning roller 55. Further, the belt cleaning roller 55 is driven and rotated in a direction (in a clockwise direction in FIG. 1) against an advancing direction of the conveying belt 31 (in the forward direction shown in FIG. 1) at a site in contact with the conveying belt 31.

Thereby, the waste toner and the paper dust attached on the conveying belt 31 are scraped away by the belt cleaning roller 55. The waste toner and the paper dust which have been scraped away from the conveying belt 31 by the belt cleaning roller 55 are deposited inside the waste toner box 57.

The waste toner sensor 59 is a sensor capable of detecting an amount of the waste toner and the paper dust deposited inside the waste toner box 57 (for example, the waste toner box 57 is nearly filled or it is filled). The waste toner sensor 59 is mounted on a waste toner sensor holder 63 integrally formed at the front side of the middle plate 61.

The middle plate 61 is a resin-made member, acting as a receiver of toner dust in a case where toner dust falls down from the vicinity of the belt unit 5 or the waste toner box 57, thereby preventing the recording medium accommodated inside the sheet feeding cassette 15 from being tainted and damaged. Further, a low-voltage power supply unit 65 and others are provided at the back of the cleaning device 13.

[Frame Structure of the Image Forming Apparatus]

Figure 2:
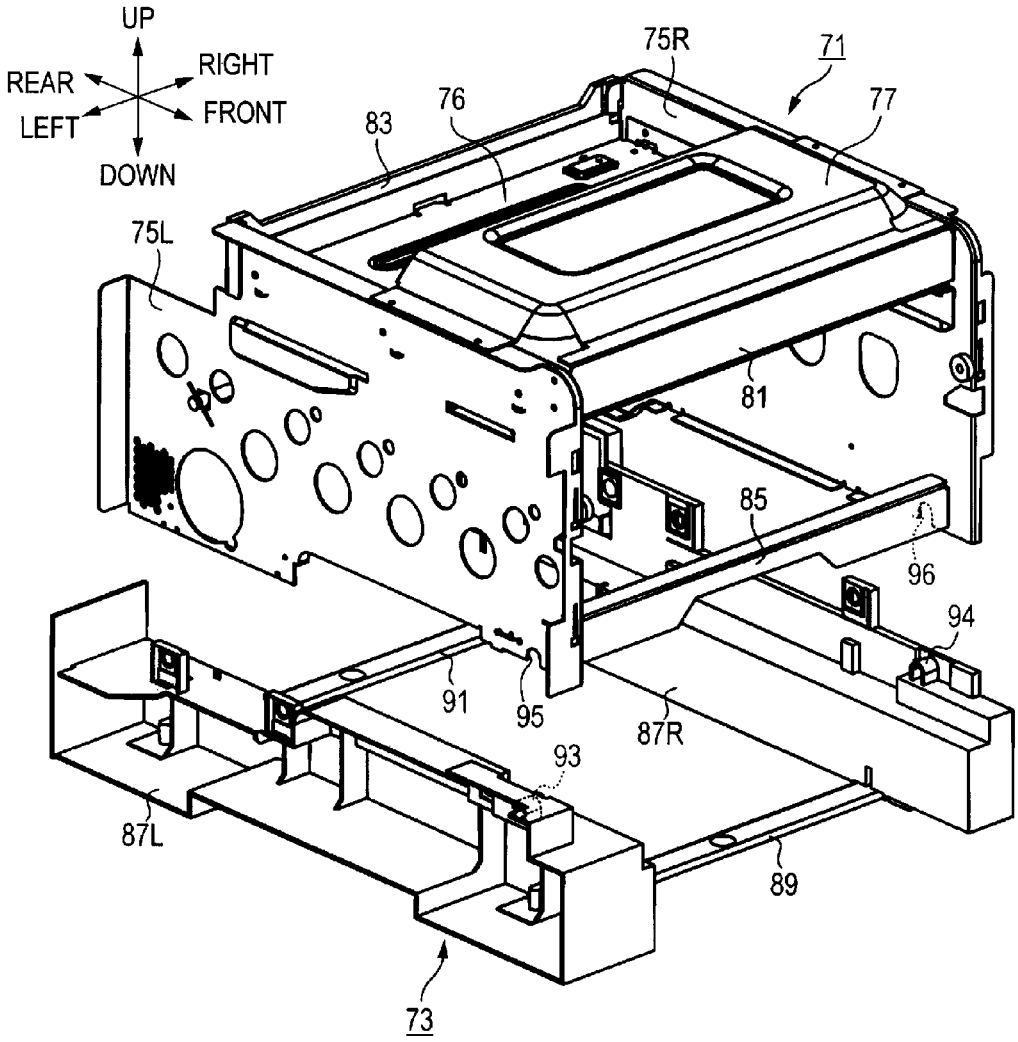
FIG. 2 is a perspective view showing an upper frame and a lower frame.

The image forming apparatus 1 includes an upper frame 71 and a lower frame 73 shown in FIG. 2 as members as framework that support the above-described various components.

Of these frames, the upper frame 71 has a sufficiently high rigid structure by assembling sheet-metal members. More specifically, the upper frame 71 includes a pair of the sheet-metal components 75L, 75R on both sides thereof. The pair of the sheet-metal components 75L, 75R are punched out respectively toward a right-left direction and installed such that spaced in the right-left direction.

Further, sheet-metal-made members such as a scanner plate 76, a scanner cover 77, a front beam 81, a rear beam 83 and an under beam 85 are installed between the sheet-metal components 75L, 75R.

The scanner plate 76 is a member installed for supporting the scanner unit 9 from below and screwed to the sheet-metal components 75L, 75R at both ends of the scanner plate 76. The scanner cover 77 is a member that cover a front half of the scanner unit 9 from above and screwed to the upper ends of the sheet-metal components 75L, 75R.

Further, the front beam 81 integrally formed with the scanner cover 77 by a bending process is installed at the front end of the scanner cover 77. The front beam 81 is also screwed to the sheet-metal components 75L, 75R. The rear beam 83 and the under beam 85 are also screwed to the sheet-metal components 75L, 75R.

On the other hand, the lower frame 73 is lower in rigidity than the upper frame 71 and structured to accept a certain deformation. Specifically, the lower frame 73 includes resin components 87L, 87R on both sides. A front beam 89, a rear beam 91 and others are installed between the resin components 87L, 87R.

The sheet-metal components 75L, 75R installed on the upper frame 71 are loaded and fixed on the resin components 87L, 87R installed on the lower frame 73. Thereby, where the upper frame 71 is loaded on the lower frame 73, the resin components 87L, 87R are in a state of supporting the upper frame 71 from below.

[Structure of Positioning the Upper Frame with Respect to the Lower Frame]

A positioning projection part 93, 94 are formed respectively on the resin components 87L, 87R, while a positioning recessed part 95, 96 are formed respectively on the sheet-metal components 75L, 75R. When the upper frame 71 is loaded on the lower frame 73, the positioning projection part 93, 94 are fitted into the positioning recessed part 95, 96.

Inner circumferences of the positioning recessed part 95, 96 are formed so as to be slightly greater than outer circumferences of the positioning projection part 93, 94. Since the positioning projection part 93, 94 are loosely fitted into the positioning recessed part 95, 96, it is possible to guide the positioning projection part 93, 94 smoothly into the positioning recessed part 95, 96.

Figure 3:
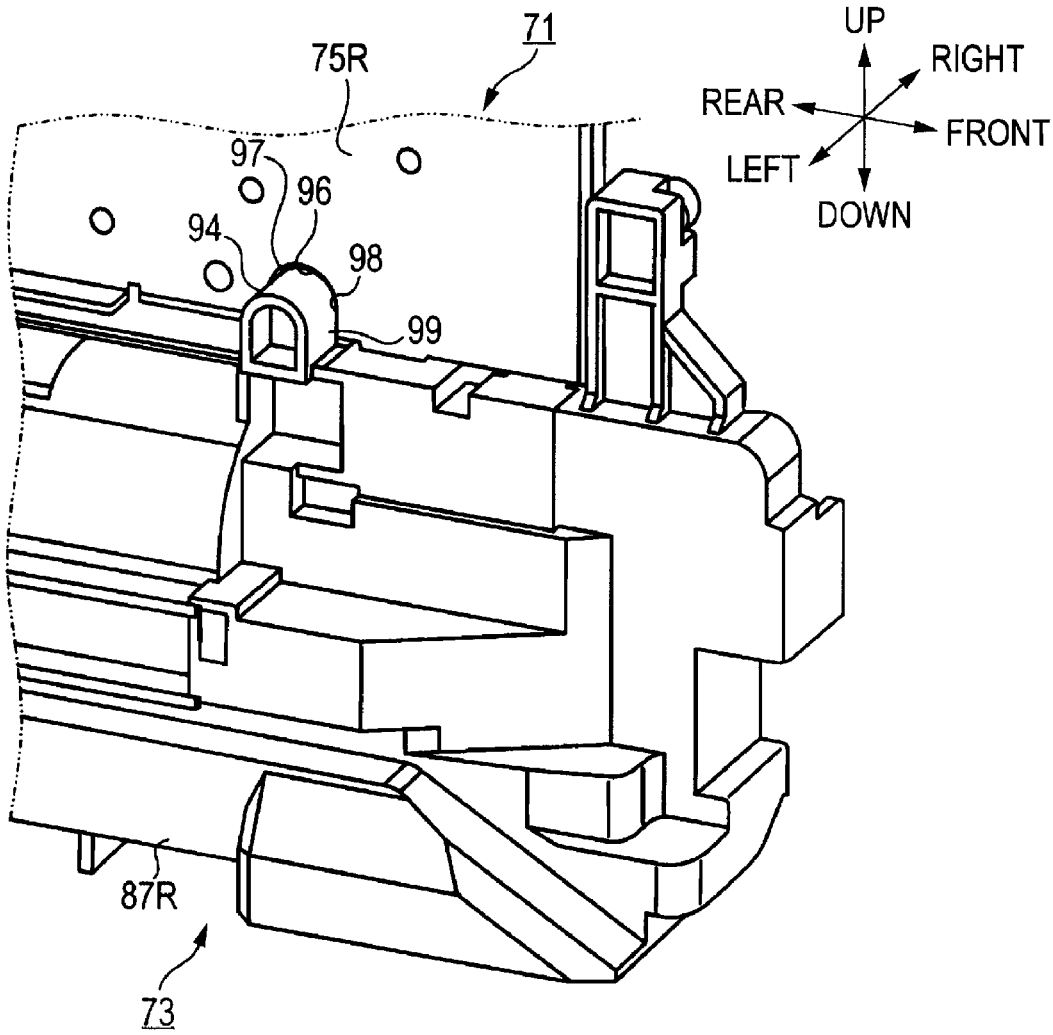
FIG. 3 is a perspective view showing vicinity at which a first contact part contact contacted part.

Further, as shown in FIG. 3, a gap 97 is formed between the inner circumference of each of the positioning recessed part 95, 96 and the outer circumference of each of the positioning projection part 93, 94 due to the above-described loosely fitted structure. FIG. 3 exemplifies the gap 97 between the positioning recessed part 96 and the positioning projection part 94. An identical gap 97 is also formed between the positioning recessed part 95 and the positioning projection part 93.

When the positioning projection part 93, 94 are inclined along with deformation of the resin components 87L, 87R or resin-made materials including the positioning projection part 93, 94 are expanded due to change in temperature, the deformation or inclination is absorbed by the gap 97 which are formed in a manner as described above. Therefore, as compared with a structure where similar gap 97 is not formed at all, this structure is capable of preventing or suppressing an excessive force from being applied to the sheet-metal components 75L, 75R.

However, when the above gap 97 is formed, the upper frame 71 is in a state of being relatively movable to the lower frame 73 in the front-rear direction only by such an extent that the gap 97 is formed. Thus, in the image forming apparatus 1, the following method is used to position the upper frame 71.

In inner circumferences of the positioning recessed parts 95, 96 in the image forming apparatus 1 an end face facing backward are given as first contact part 98. In outer circumferences of the positioning projection part 93, 94 in the image forming apparatus, a face facing forward are given as contacted part 99. Then, in a state that the first contact part 98 is in contact with the contacted part 99, the upper frame 71 is fixed to the lower frame 73. When these components are fixed according to the above method, the upper frame 71 is accurately positioned with respect to the contacted part 99, despite the fact that the above gap 97 is formed.

[Structure of Screwing Clamp of the Upper Frame and the Lower Frame]

Figure 4A:
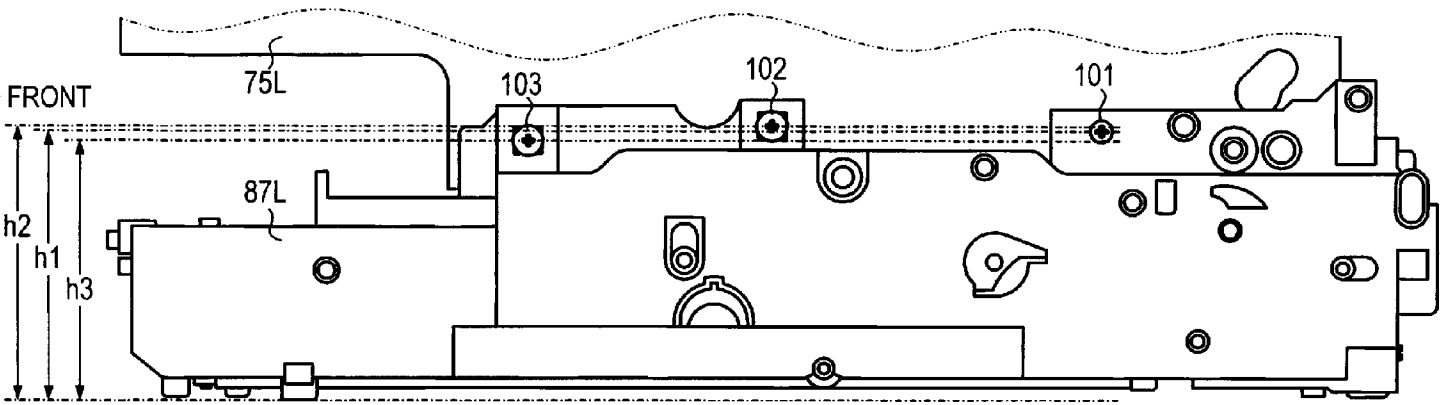
Figure 4B:
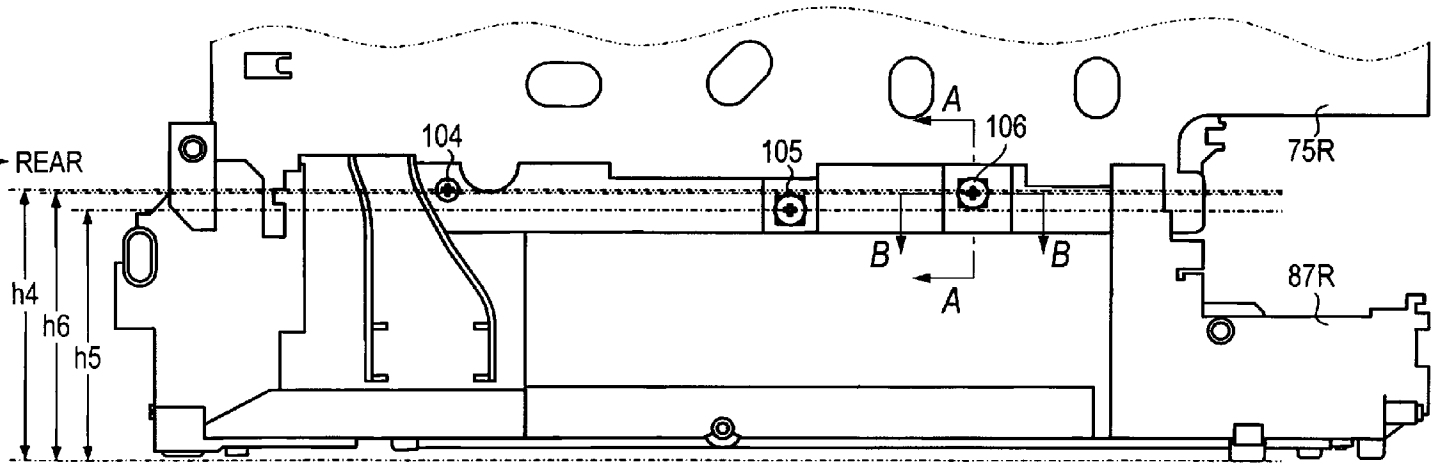
FIG. 4B is a right side view showing site at which the other sheet-metal component is screwed to the lower frame.

The upper frame 71 is screwed to the lower frame 73 at three sites on each side (a total of six sites on both sides). More specifically, as shown in FIG. 4A and FIG. 4B, on the left side, three screws 101, 102, 103 are used to fix the sheet-metal component 75L to the resin component 87L. Further, on the right side, three screws 104, 105, 106 are used to fix the sheet-metal component 75R to the resin component 87R.

Further, the three fixed sites on each side are respectively different in vertical positions (heights of three fixed sites h1, h2, h3 as shown in FIG. 4A, and heights of three fixed sites h4, h5, h6 as shown in FIG. 4B). One of these three sites on each side is positioned so as to be deviated from straight lines passing through the other two sites.

Since the fixed sites are made as described above, it is possible to arrange these three fixed sites in such a positional relationship as to depict a triangle. The structure is capable of suppressing the occurrence of bending that given the straight lines connecting two sites as a ridge by the remaining one site. Therefore, as compared with a case where the three fixed sites are aligned, a resistance against bending at which the above straight lines are given as a ridge is provided. It is possible to improve the strength of each of the sheet-metal components 75L, 75R when mounted on the lower frame 73.

Moreover, at a fixed site (a site fixed with the screw 101 or 104), which is one of the three fixed sites on each side, and which is closest to a position at which the first contact part 98 contact the contacted part 99, a round hole equal in diameter to the shaft of the screw 101 or 104 (not illustrated) is formed on each of the resin components 87L, 87R. Then, the shaft of the screw 101 or 104 is passed through the round hole, the shaft is screwed into the screw hole on each of the sheet-metal components 75L, 75R (not illustrated).

Therefore, the sites fixed with the screws 101, 104 provided a fixed structure that no relative displacement of the lower frame 73 with respect to the sheet-metal components 75L, 75R is accepted, even when the lower frame 73 is twisted or distorted. Hereinafter, the site fixed with the screws 101, 104 is also called to as a reference fixed site.

Figure 5A:
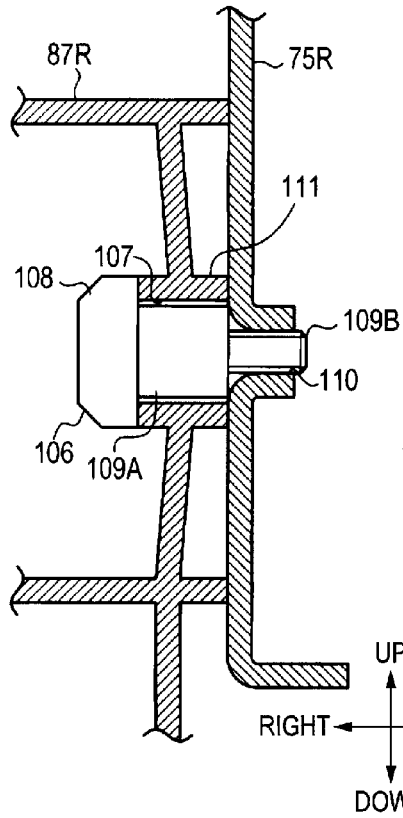
FIG. 5A is a cross sectional view of a cross section indicated by the line A to A in FIG. 4B.

On the other hand, at fixed sites other than the reference fixed site (sites fixed with screws 102, 103, 105, 106), oblong holes 107 longer in the front-rear direction than shaft diameters of the screws 102, 103, 105, 106 (refer to the vicinity of the screw 106 illustrated in FIG. 5A to 5C) are formed on the resin components 87L, 87R.

Further, the screws 102, 103, 105, 106 are a type of screws which are called a stage screw. Each of the screws includes a head 108, a larger diameter portion 109A and a smaller diameter portion 109B. The larger diameter portion 109A is passed through an oblong hole 107 and the smaller diameter portion 109B is screwed into a screw hole 110 on each of the sheet-metal components 75L, 75R.

Figure 5B:
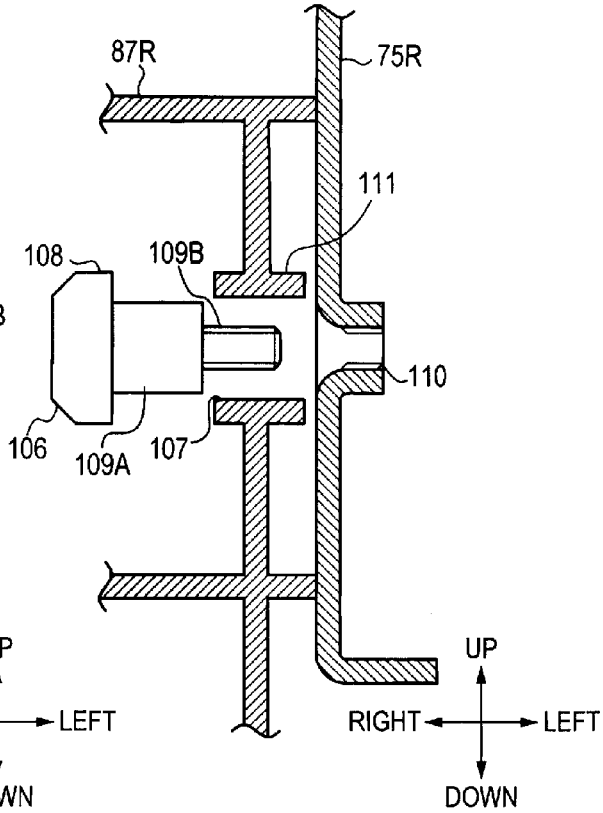
FIG. 5B is an exploded view of the site indicated in FIG. 4B.
Figure 5C:
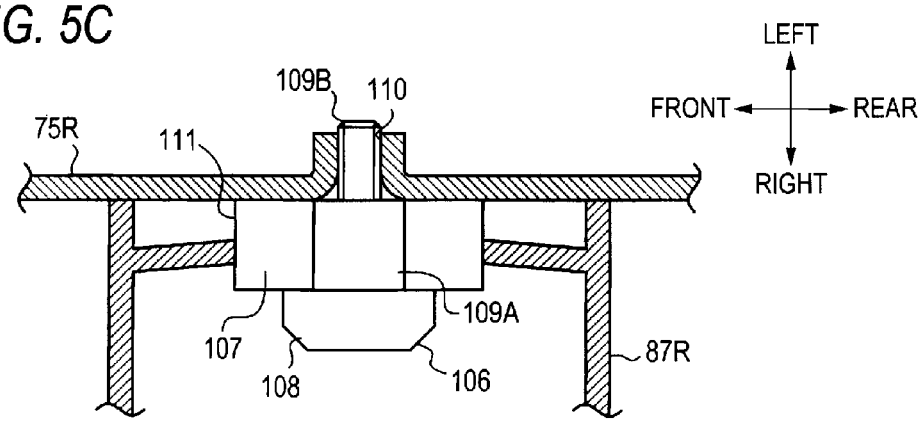
FIG. 5C is a cross sectional view of a cross section indicated by the line B to B in FIG. 4B.

In this instance, a resin-made portion 111 (a portion of each of the resin components 87L, 87R) around the oblong hole 107 is positioned so as to be spaced away from each of the sheet-metal components 75L, 75R before the smaller diameter portion 109B is screwed into the screw hole 110 on each of the sheet-metal components 75L, 75R (refer to FIG. 5B). On the other hand, when the smaller diameter portion 109B is screwed into the screw hole 110 on each of the sheet-metal components 75L, 75R, the head 108 presses the resin-made portion 111 around the oblong hole 107 to each of the sheet-metal components 75L, 75R. Upon receiving this pressing force, the resin components 87L, 87R undergo a partial elastic deformation. As a result, the resin-made portions 111 around the oblong holes 107 contact sheet-metal components 75L, 75R (refer to FIG. 5A and FIG. 5C).

At this time, the larger diameter portion 109A acts as a spacer for preventing the resin-made portion 111 around the oblong hole 107 from being inserted by an excessive force. Therefore, the resin-made portions 111 around the oblong holes 107 are in a state of being relatively displaceable in the front-rear direction with respect to the screws 102, 103, 105, 106.

Therefore, the resin components 87L, 87R are in such a state that a relative displacement is allowed in the front-rear direction with respect to the screws 102, 103, 105, 106 and the sheet-metal components 75L, 75R. In other words, fixed sites (sites fixed with the screws 102, 103, 105, and 106) other than the reference fixed site are given such a fixed structure that a relative displacement of the lower frame 73 with respect to the sheet-metal components 75L, 75R is allowed when the lower frame 73 is twisted or distorted.

When the fixed structure is provided, a relative displacement of the lower frame 73 with respect to the sheet-metal components 75L, 75R is less likely to take place at the reference fixed site. Then, upon deformation of the lower frame 73, the first contact part 98 can be kept in contact with the contacted part 99. Further, at fixed sites other than the reference fixed sites, no excessive force is applied to the sheet-metal components 75L, 75R upon deformation of the lower frame 73. It is, therefore, possible to prevent or suppress the sheet-metal components 75L, 75R from being deformed.

[Structure of Positioning the Sheet Feeding Unit with Respect to the Lower Frame]

Figure 6:
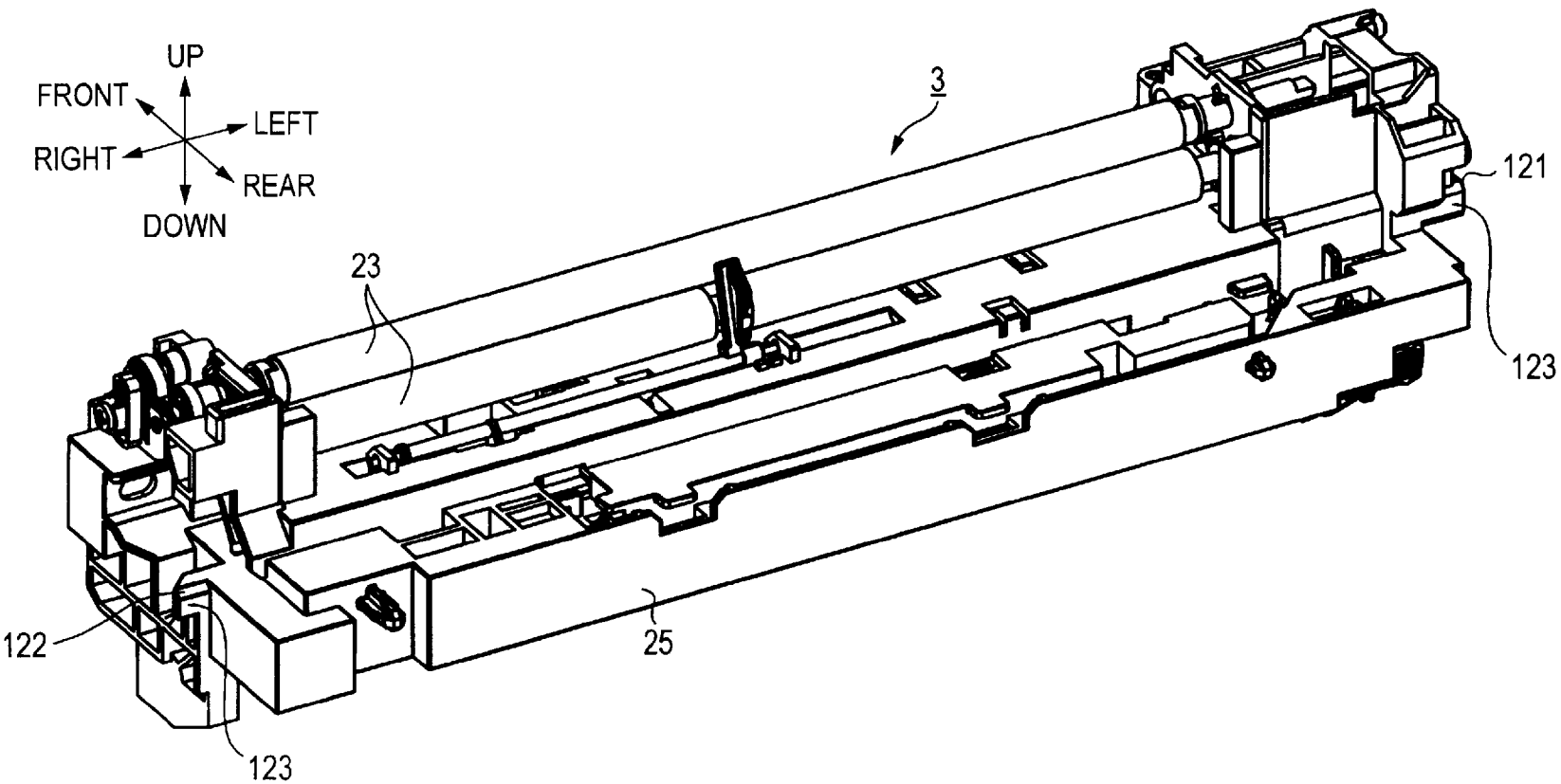
FIG. 6 is a perspective view showing a sheet feeding unit.

The sheet feeding frame 25 installed on the sheet feeding unit 3 is a shaped article made with a resin-made material. As shown in FIG. 6, the positioning projection 121, 122 are formed at both ends of the sheet feeding frame 25. Then, the face on the positioning projections 121, 122 facing backward are given as second contact part 123 which are used in positioning the sheet feeding unit with respect to the lower frame 73.

Figure 7A:
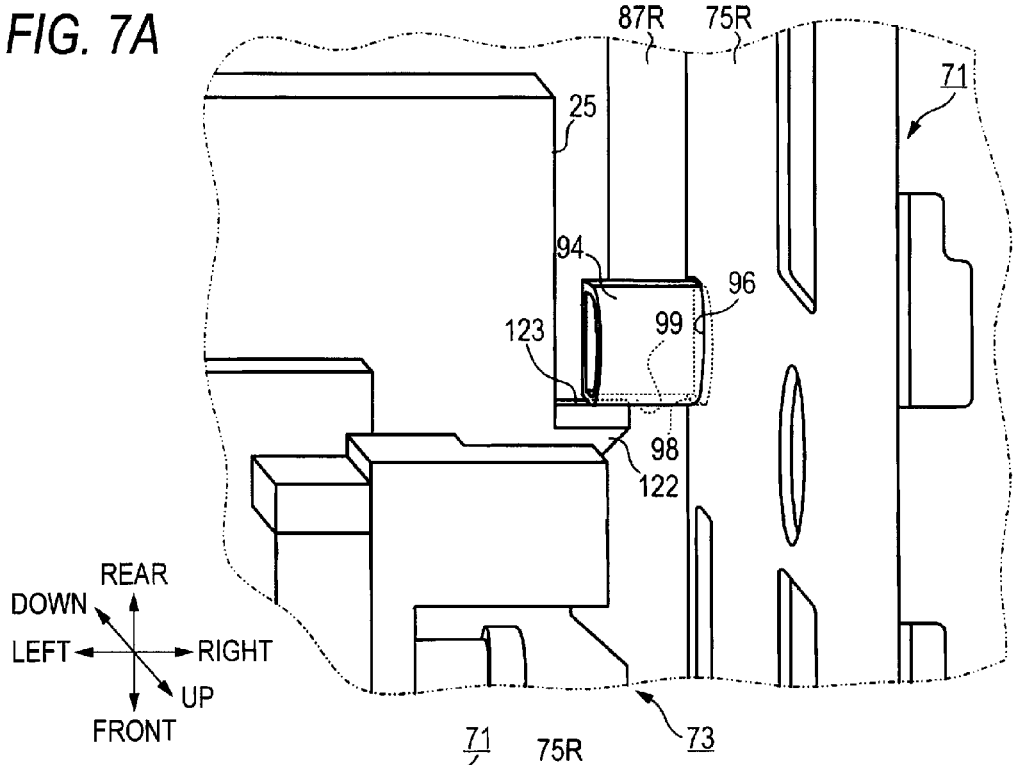

The second contact part 123 are, as shown in FIG. 7A, kept in contact with the contacted part 99 on the positioning projection part 93, 94 when the sheet feeding frame 25 is loaded on the lower frame 73. Thereby, the sheet feeding unit 3 is positioned accurately with respect to the contacted part 99.

In this instance, as described previously, the contacted part 99 are also given as part which are in contact with the first contact part 98 on inner circumferences of the positioning recessed part 95, 96 installed at the sheet-metal components 75L, 75R which is installed the upper frame 71.

Therefore, the upper frame 71 and the sheet feeding frame 25 are both positioned accurately with respect to the same contacted part 99. Thereby, the upper frame 71 is accurately positioned relatively with respect to the sheet feeding frame 25 in the front-rear direction.

Incidentally, the upper frame 71 can be positioned relatively with respect to the sheet feeding frame 25 in the front-rear direction by the upper frame 71 contacting directly with the sheet feeding frame 25.

Figure 7B:
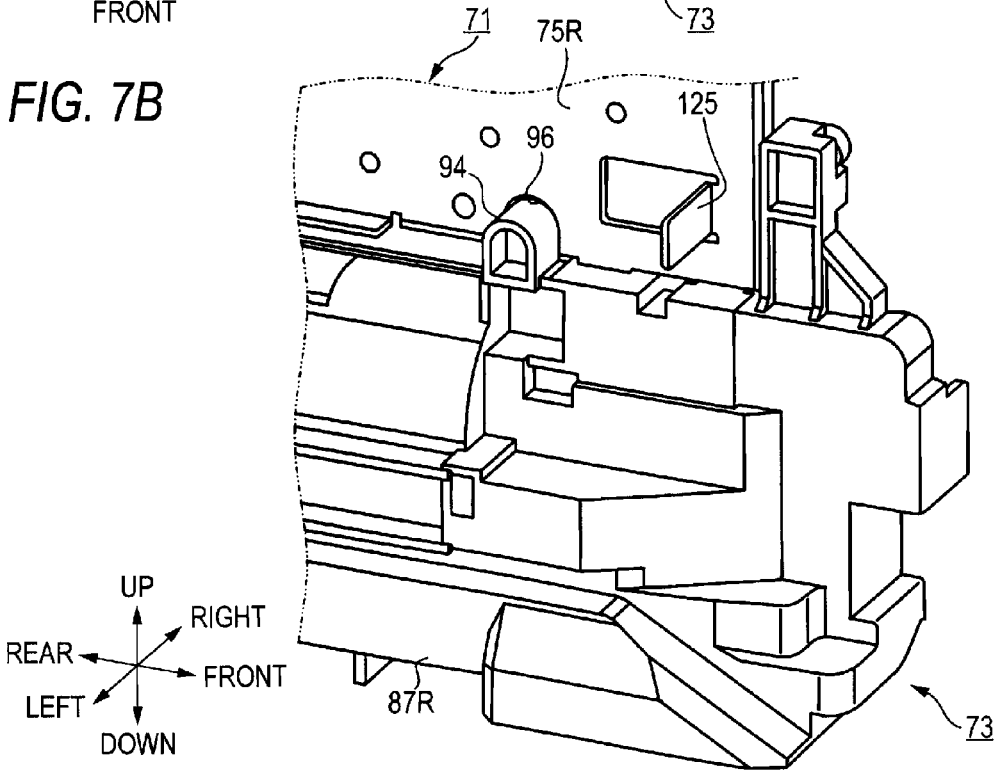
FIG. 7B is a perspective view showing an example in which, in addition to the contacted part to be in contact with the first contact part, the contacted part to be in contact with the second contact part is formed on the sheet-metal component.

There is a case where the sheet feeding frame 25 is placed between a pair of sheet-metal components 75L, 75R which are punched out toward the right-left direction and arranged in parallel. However, in this case, in order that the sheet-metal component 75L, 75R contact directly with the sheet feeding frame 25, a structure is required that bent part 125 illustrated in FIG. 7B are installed on the sheet-metal component 75L, 75R and the sheet feeding frame 25 is brought into contact with the bent part 125.

Therefore, if the bent part 125 is not accurately processed, it is difficult to optimize a relative positional relationship between the upper frame 71 and the sheet feeding frame 25. Further, with the characteristics of a bending process taken into account, it is not necessarily easy to increase the processing accuracy.

In this respect, the positioning recessed part 95, 96 installed on the sheet-metal component 75L, 75R are provided with inner circumference faces which are end faces formed when the sheet-metal component 75L, 75R are punched out. Therefore, unlike faces which are turned in a specific direction by a bending process, the inner circumference faces are higher in dimensional accuracy.

Therefore, as described above, the contacted part 99 is used to optimize a relative positional relationship between the upper frame 71 and the sheet feeding frame 25. Thereby, the positioning can be made more accurately than a case where such a structure is adopted that the bent part 125 are used the upper frame 71 contacting directly with the sheet feeding frame 25.

[Structure of the Middle Plate]

Figure 8A:
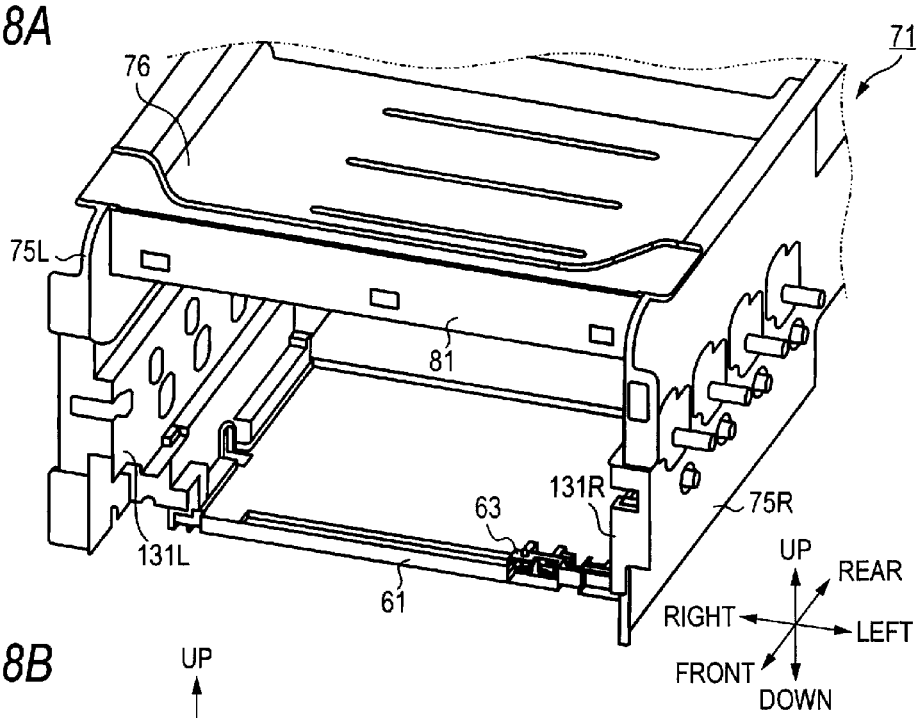
FIG. 8A is a perspective view showing a middle plate and the vicinity thereof.
Figure 8B:
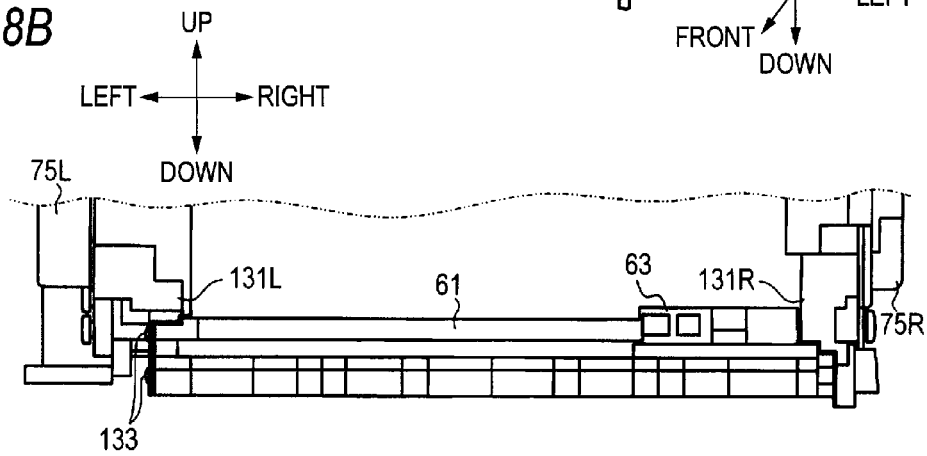
FIG. 8B is a front view showing the middle plate and the vicinity thereof.
Figure 8C:
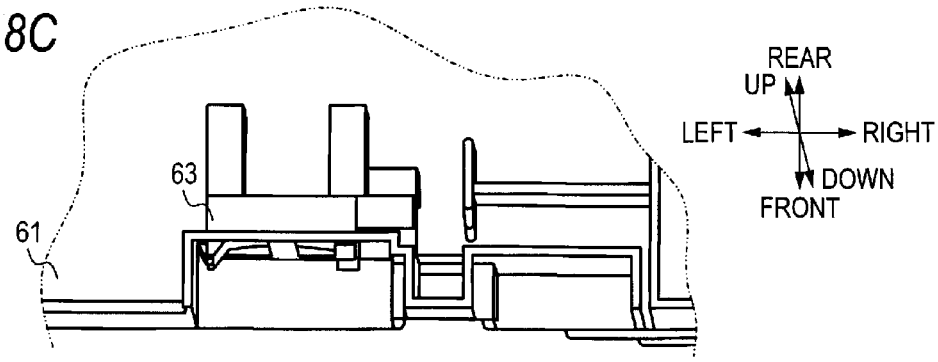
FIG. 8C is a perspective view showing a waste toner sensor holder integrally formed on the middle plate.

In the image forming apparatus 1, the middle plate 61 has a shaped article made with the resin-made material. As shown in FIG. 8A to 8C, the middle plate 61 is mounted on the sheet-metal components 75L, 75R via resin-made inner frames 131L, 131R mounted on the sheet-metal components 75L, 75R.

The right end of the middle plate 61 is fitted into the inner frame 131R, while the left end of the middle plate is fixed to the inner frame 131L with the screw 133. Further, the waste toner sensor holder 63 is integrally formed with a resin-made material at the front end of the middle plate 61.

As described above, unlike a similar middle plate formed with a sheet-metal component, the middle plate 61 formed with a resin-made material is able to eliminate the necessity for grounding the middle plate 61 and simplify an inner structure of the image forming apparatus 1 accordingly.

Further, unlike a similar middle plate formed with a sheet-metal component, the middle plate 61 integrally formed with the waste toner sensor holder 63 by using a resin-made material is able to eliminate the necessity for providing a waste toner sensor holder separate from the middle plate. Also eliminated is the necessity for installing the holder separate from the middle plate. Thus, it is possible to reduce the number of components necessary for manufacturing the image forming apparatus 1 and simplify work procedures.

Still further, there is a fear that installation of a middle plate excessively high in rigidity on the upper frame 71 could contribute to distortion of the upper frame 71 due to force applied to the upper frame 71 on installation thereof. However, since the resin-made middle plate 61 is lower in rigidity than the upper frame 71 made with a sheet-metal component, the upper frame 71 is less likely to cause unexpected distortion.

[Advantages]

Accordingly, the first contact part 98 formed on a end face 98 in the upper frame 71, the end face formed by punched out in sheet-metal component 75L, 75R. Therefore, the first contact part 98 can be formed more accurately than part a bending process in the upper frame 71.

Further, since the sheet feeding frame 25 is a resin component, it is possible to form accurately the second contact 123 part formed on the sheet feeding frame 25 as well.

Therefore, both of the first contact part 98 and the second contact part 123, which have been accurately formed, are contacted with the contacted part 99 formed on the lower frame 73. Thereby, the upper frame 71 can be accurately positioned relatively with respect to the sheet feeding frame 72 in the front-rear direction, in spite of the upper frame is not contacting directly with the sheet feeding frame.

Thus, the registration rollers 23 (corresponding to one example of the sheet feeding unit in the present invention) incorporated into the sheet feeding frame 25 and the process cartridges 7 (corresponding to one example of the image forming unit in the present invention) supported on the upper frame 71 are arranged so as to give an appropriate positional relationship in the front-rear direction.

Accordingly, after a recording medium is positioned for the leading end by the registration rollers 23, the recording medium is sent to the downstream side of a conveying path extending in the front-rear direction. At this time, the recording medium arrives at the process cartridges 7 accurately in the front-rear direction. Thereby, it is possible to improve the accuracy of an image forming position on the recording medium.

Further, accordingly, the positioning projection part 93, 94 are fitted into the positioning recessed part 95, 96, by which the first contact part 98 are arranged in such a position as to oppose the contacted part 99. Thus, the first contact part 98 are easily contacting with the contacted part 99.

Further, accordingly, when the first contact part 98 are allowed to be in contact with the contacted part 99, the gap 97 is formed between portions of the outer faces of the positioning projection part 93, 94 which face backward and portions of the inner faces of the positioning recessed part 95, 96 which face forward. Therefore, the positioning projection part 93, 94 are allowed to be deformed or inclined along with deformation of the lower frame 73, thereby giving no adverse influence to the position or the dimensional accuracy of the upper frame 71.

Still further, at least one fixed site (for example, sites fixed with the screws 103, 106) is deviated from straight lines passing through the other two fixed sites (for example, straight lines passing through sites fixed with the screws 101, 102 and straight lines passing through sites fixed with the screws 104, 105). These three fixed sites are arranged in such a positional relationship as to depict a triangle. Thus, as compared with a case where the three fixed sites are aligned, it is possible to improve the strength of each of the sheet-metal components 75L, 75R when mounted on the lower frame 73.

In addition, the reference fixed sites (sites fixed with the screws 101, 104) closest to positions where the first contact part 98 are in contact with the contacted part 99 are given such a fixed structure that no relative displacement of the lower frame 73 with respect to the sheet-metal components 75L, 75R is allowed upon deformation of the lower frame 73. Therefore, upon deformation of the lower frame 73, the first contact part 98 can be kept in contact with the contacted part 99. Further, fixed sites (sites fixed with the screws 102, 103, 105, 106) other than the reference fixed sites are given such a fixed structure that a relative displacement of the lower frame 73 with respect to the sheet-metal component 75L, 75R is allowed upon deformation of the lower frame 73. Therefore, no excessive force is applied to the sheet-metal component 75L, 75R upon deformation of the lower frame 73, thus making it possible to prevent or suppress the sheet-metal component 75L, 75R from being distorted or twisted.

Other Embodiments

A description has been so far given for an embodiment of the present invention. However, the present invention shall not be limited to the above specific one embodiment but may be executed in other various modes.

For example, in the above embodiment, stage screws are used at fixed sites (sites fixed with the screws 102, 103, 105, 106) other than the reference fixed sites. However, in place of the stage screws, ordinary screws into which a cylindrical spacer is fitted may be used to configure a structure similar to that of the above embodiment.

Further, in the above embodiment, part given as the contacted part 99 are formed with a resin-made material. However, the part given as the contacted part 99 may be formed with a sheet-metal component or other materials. In this instance as well, the first contact part 98 and the second contact part 123 are allowed to be in contact with the contacted part, thus making it possible to optimize a relative position of the upper frame 71 with respect to the sheet feeding frame 25 in the front-rear direction.

It is also preferable to optimize a relative position of the lower frame 73 with respect to the upper frame 71 and the sheet feeding frame 25. Further, it is preferable that the lower frame 73 has a structure which allows a certain deformation. Therefore, with this point taken into consideration, the lower frame 73 is not formed with a sheet-metal component but is preferably structured by using the above-described resin components 87L, 87R.

What is claimed is:

1. An image forming apparatus comprising:

an image forming unit that forms an image on a recording medium;

a sheet feeding unit that feeds the recording medium to the image forming unit, the sheet feeding unit positioning a leading end of the recording medium and feeding the recording medium to a downstream side of a conveying path extending in a front-rear direction;

an upper frame comprising:

a pair of sheet-metal components, each of which is punched out in a right-left direction substantially perpendicular to the front-rear direction, and which defines a space therebetween in the right-left direction; and a first contact part, which is an end face formed when the pair of sheet-metal components was punched out, and which faces a first direction, wherein the upper frame supports the image forming unit from the right-left direction by the pair of sheet-metal components;

a sheet feeding frame, which is made of a resin component, which is arranged between the space defined by the pair of sheet-metal components, and to which the sheet feeding unit is mounted, the sheet feeding frame comprising a second contact part at a face facing the first direction; and a lower frame, which supports the upper frame and the sheet feeding frame from below, and which comprises a contacted part that faces a second direction opposite to the first direction, wherein a relative position in the front-rear direction between the upper frame and the lower frame is defined by contacting the contacted part with both of the first contact part and the second contact part.

2. The image forming apparatus according to claim 1, wherein the lower frame further comprises a positioning projection part that is projected upward, wherein the upper frame further comprises a positioning recessed part, which is formed when the pair of sheet-metal components was punched out, and which is recessed from a lower end of the pair of sheet-metal components toward upward, wherein the contacted part is an outer face of the positioning projection part facing forward, and wherein the first contact part is an inner face of the positioning recessed part facing backward.

3. The image forming apparatus according to claim 2, wherein, when the positioning projection part is mounted to the positioning recessed part to contact the first contact part with the contacted part, a gap is formed between an outer face of the positioning projection part facing backward and an inner face of the positioning recessed part facing forward.

4. The image forming apparatus according to claim 1, wherein each of the pair of sheet-metal components is fixed to the lower frame at three or more fixed sites, and wherein at least one of the fixed sites is deviated from straight lines passing through other two of the fixed sites.

5. The image forming apparatus according to claim 4, wherein a reference fixed site, which is one fixed site closest to a contact position of the first contact part and the contacted part, and which has a first fixed structure that prevents relative displacement between the lower frame and the pair of sheet-metal components even when the lower flame is deformed, and wherein each of the fixed sites other than the reference fixed site has a second fixed structure that allows relative displacement between the lower frame and the pair of sheet-metal components when the lower frame is deformed.

* * * * *